United States Patent [19]

Krafft

[11] 3,978,529

[45] Sept. 7, 1976

[54] POWDER ROOM AND BATHROOM SYSTEM

[75] Inventor: Kurt Krafft, Prospect, Ky.

[73] Assignee: Systems Design & Development, Prospect, Ky.

[22] Filed: Oct. 15, 1974

[21] Appl. No.: 514,807

[52] U.S. Cl. ..... 4/2; 4/3; 4/191; 52/35

[51] Int. Cl.[2] ..... A47K 4/00

[58] Field of Search ..... 4/2–5, 191, 4/192, 211, DIG. 7; 52/34, 35, 79, 220; 137/357, 359

[56] References Cited

UNITED STATES PATENTS

| | | | |
|---|---|---|---|
| 2,653,357 | 9/1953 | Sanders et al. | 4/2 |
| 3,110,907 | 11/1963 | King | 4/2 |
| 3,221,454 | 12/1965 | Togni | 4/192 X |
| 3,230,549 | 1/1966 | McMurtrie et al. | 4/2 |
| 3,590,392 | 7/1971 | Hollander et al. | 4/2 |
| 3,620,246 | 11/1971 | Shoquist | 4/2 X |
| 3,694,973 | 10/1972 | Unger | 52/34 |
| 3,707,165 | 12/1972 | Stahl | 52/34 X |
| 3,766,574 | 10/1973 | Smid | 4/2 X |
| 3,774,631 | 11/1973 | Willkins | 4/211 X |

*Primary Examiner*—Richard E. Aegerter
*Assistant Examiner*—Stuart S. Levy
*Attorney, Agent, or Firm*—Pennie & Edmonds

[57] ABSTRACT

A combination of pre-dimensioned and pre-engineered modular units which form at least a powder room within a room section of a building structure and a method of assembling same. The assemblage includes an interface unit having a drain-waste-vent piping system for the room, the unit being mounted to the surface of the "wet wall" of the room. The walls of the room may be either partially finished or completely finished at the time of assembly of the facility. The interface unit provides a unique template for locating the positions of, and for installing the components of the facility. By extending the powder room assemblage to include a bathtub and shower section, a unique full bathroom may be assembled in a very short time according to the method of the invention by persons of limited skills.

8 Claims, 21 Drawing Figures

114
118
120
124
126
108
122
114
112
128
130
110
134
16
28
136
30
10

POWDER ROOM AND BATHROOM SYSTEM

BACKGROUND OF THE INVENTION

1. Field of the Invention

This invention relates to pre-engineered modular powder rooms, bathrooms and components thereof, and a method of assembling same.

2. Description of the Prior Art

Conventional powder rooms, bathrooms and the like are generally completed by installing simultaneously, the rough plumbing into the "wet wall" of the room and the fixtures of the bathroom or powder room. It is always necessary to cut the pipe members and required components to the proper size in-situ in order to adapt them for assembled installation in the room space designated for the facility. This time consuming procedure often necessitates excessive waste and substantial material costs while necessitating ever-increasing labor costs to assemble the facility. In addition, it is always impossible to finish or to provide any decorative finishing to the wall surface of the room before the fixtures have been installed. This makes it necessary to provide such finishing decorations only after the time consuming task of assembling the room components has been completed. Ever-increasing risks must be taken that the powder room or bathroom components — which are often formed of porcelain or china — will be damaged during the heavy plumbing installation procedures.

Attempts have been made to simplify and reduce the costs of assembling such facilities, however none have been successful in anticipating all of the inherent problems sufficiently such that they may be "designed" out of the system before the elements are produced and/or installed. U.S. Pat. No. 3,230,549 to G. McMurtrie et al relates to a Modular Frame Construction And Installation of Bathroom Fixtures to be installed in a building. The frame construction is intended to support components such as plumbing fixtures; however, unlike my invention it is nevertheless necessary to install all the requisite pipes and pipe chase in the wet wall in a conventional manner. U.S. Pat. No. 3,221,454 to G. Togni relates to a Pre-Fabricated Utility Building Assembly in which a frame section is provided having pre-assembled household plumbing mounted therein such that it may be mounted bodily and embedded within a building structure. U.S. Pat. No. 3,765,036 to D. P. Dyrstra relates to an assemblage of Modular Laboratory Cabinets adapted to be positioned along a wall for use in a laboratory room and the like. U.S. Pat. No. 3,707,165 to J. S. Stahl relates to a wall unit having integrally formed surface panels and a foam core which encloses, supports and positions hot and cold water pipes, drain and vent piping with electrical wiring. None of these patents disclose or suggest an assemblage of pre-dimensioned and pre-engineered modular components to facilitate the provision of a powder or bathroom even similar to the assemblage which I have invented. Other related prior art patents are as follows: U.S. Pat. No. 3,790,967 to J. M. Pignato relates to a Water Closet; U.S. Pat. No. 3,620,246 to Shoquist relates to a plumbing apparatus for draining water from tubs, commodes, etc. in a limited vertical space and with a single sewer connection. U.S. Pat. No. 2,027,371 to R. L. Davison relates to a Factory Fabricated Rough Plumbing Unit. U.S. Pat. No. 3,694,973 to D. Unger relates to Utility Module For Apartment-Type Dwellings. U.S. Pat. No. 2,004,933 to R. L. Davison relates to a Bathroom Unit.

U.S. Pat. No. 2,653,357 to J. F. Sanders et al relates to a Prefabricated Plumbing Installation; U.S. Pat. No. 1,978,842 to P. R. Hooton relates to a Building Construction having a built-in fabricated metal bathroom. None of these patents disclose or suggest an assemblage of modular units or a method of assembling same to provide a bathroom or powder room such as I have invented. Other prior art patents related to the subject matter of the present invention are as follows:

U.S. Pat. No. 2,787,027 to A. A. Baker
U.S. Pat. No. 2,901,780 to G. G. Rothenstein
U.S. Pat. No. 3,143,744 to H. R. Greer
U.S. Pat. No. 3,740,908 to J. W. Moore My invention makes it possible to quickly assemble a plurality of pre-dimensioned and pre-engineered modular units to form either a powder room or bathroom in a limited room space which may be unfinished, partially finished, or completely finished, in a simplified manner which eliminates all excessive costs while providing a superior installation. Moreover it is now possible for an individual having limited skills to assemble such a facility due to the simplified method which I have invented.

SUMMARY OF THE INVENTION

An assemblage of a plurality of pre-dimensioned and pre-engineered modular units forming at least a powder room within a room section of a building structure wherein an interface frame is mounted in adjacent relation to a wet wall of the room, the wet wall having the piping system of the building structure extending therethrough and the interface frame being formed of a structural frame members so dimensioned and capable of being connected as to selectively establish at least the locating positions of a modular toilet bowl and lavatory section along the wet wall of the room. a drain-waste-vent pipe unit is supported substantially vertically in the wet wall of the room and connected to the drain-waste-vent pipe system of the building structure. Drain-waste-vent pipe members are connected in end-to-end relation and supported within the interface frame to form an interface unit comprising a drain-waste-vent pipe system for the room. The invention further comprises means for connecting at least the outlet drain portions of modular powder room fixtures thereto, and means for connecting the venting system of the interface unit to the venting system of the building. A modular pre-dimensioned toilet bowl is supported on the floor of the room and positioned adjacent the frame unit at the toilet position thereof, the toilet bowl having a flush water inlet and a waste outlet at the rear portion thereof with means to secure the rear portion of the bowl against the interface frame unit. A substantially finished shroud member is positioned about the toilet bowl and adjoins the interface unit, the shroud having a flush water supply and control means adapted to selectively direct flush water to the rear inlet portion of the toilet bowl. The invention further comprises means to connect the rear waste outlet of the toilet bowl to a waste inlet opening of the drain-waste-vent pipe unit and a lavatory section positioned against the interface frame unit at the lavatory portion of the interface frame. The lavatory section has a modular cabinet member, a wash bowl supported on the cabinet member having a water supply and control means and having means connecting a drain outlet thereof to the drain inlet opening of the drain-waste-vent pipe system of the interface frame unit, and a finished shroud positioned above the wash bowl and cabinet. The invention further comprises water supply means connecting the building water supply to the toilet bowl and water supply system of the wash bowl. The interface unit and pipe system of the present invention conveniently establish a template for at least a powder room such that the modular fixtures may be conveniently installed in the room section of the building structure after at least a portion of the room has been finished, particularly due to the convenient wall surface mounting capability of the interface unit. This convenience is also extended to provide the capability of assembling the powder room according to numerous arrangements such as in a left hand arrangement, a right hand arrangement, or multiple facilities in back-to-back relation, etc.

In another embodiment the invention further comprises a bathtub section connected to the interface frame unit with an assemblage comprising additional drain-waste-vent pipe members, a bathtub portion extending the interface frame to support the bathtub section of the pipe system, a uniquely configured bath tub and wall surround members which complete the assemblage to form a full bathroom.

The prefabrication of the components form rapidly and easily installed powder rooms or bathrooms having left hand arrangements in single or multi-storied buildings and installed either as single bathrooms or powder rooms or in a multiplicity or back-to-back arrangements with other bathrooms, powder rooms, kitchens or utility rooms. Although it is primarily contemplated to be utilized with residential structures, the invention is also suitable for use in other types of structures requiring washroom or bathroom facilities. Further, the invention can be installed in a pre-finished or finished decorated room as well as being applicable to all current building methods. It is particularly suitable for installation in new buildings or in the renovation of old buildings and requires no more area in a building than that conventionally assigned for bathrooms or powder rooms. As will be seen in the description which follows, the invention facilitates easy access for any needed repairs or replacements without effecting any finished wall, floor or ceiling surface, and it does not encompass any secondary or duplicated wall, floor or ceiling structures. Further, it does not preempt conventional room construction or surface materials and complies with existing plumbing codes while allowing for variations in plumbing codes as they may vary from place to place. It allows for individual selection of room colors and decorations rather than commercially selected colors, textures, patterns and combinations thereof which may or may not be suitable to the individual.

It will be seen that the invention broadly relates to at least four basic elements which provide the basic flexibility of the arrangement as follows:

1. The drain-waste-vent pipe unit.
2. The wall surface mounted interface unit formed of an interface frame having drain-waste-vent pipe members connected in end-to-end relation and supported within the frame.
3. The toilet section.
4. The lavatory section.

By incorporation of a fifth section in the form of a bathtub section, a complete bathroom is formed.

The interconnecting means utilized in combination with pipe members such as water lines, vent lines, drain lines, etc. contemplate the use of any of a plurality of currently available connecting means such as thread members, unions, sweated joints, snap-on devices and the like used with pipe members manufactured of suitable materials such as iron, copper, brass, plastics and the like. Any suitable means to secure the pipe members in position within the interface frame such as clips, snap-on devices, etc., are also contemplated.

It is also contemplated within the scope of the invention to incorporate an interface unit in the form of a frame section having a manifold section in which the pipe members are formed from at least two plate sections joined in back-to-back relation, each having tunnel like formations in face-to-face relation with each other to form conduits which will comprise the pipe members of the unit.

The invention also pertains to a uniquely configured modular toilet bowl which is floor supported and which has a flush water inlet and waste outlet at the rear portion thereof so as to facilitate a single step attachment to the corresponding toilet section of the interface unit or to a wet wall. Still another feature of the invention pertains to a uniquely configured bathtub which is peculiarly adapted for installation into the bathroom of the invention due to its arcuately configured end portion which makes it possible to conveniently rotate it into position into the bathtub section of limited dimensions. A significant advantage of my invention relates to the capability of installing the powder room and bathroom components after the room is finished or semi-finished. This minimizes the risk of damage to the components which are often manufactured of breakable materials such as china. The risk is inherent when a unit such as a china or glass bathtub, wash bowl, or toilet bowl is installed requiring rough plumbing for the necessary connections. According to my invention all of the rough plumbing is completed prior to the installation of the room components.

The invention also relates to a method of assembling a plurality of pre-dimensioned and pre-engineered modular units to form at least a powder room within a room section which comprises: taking the structural members of an interface frame unit; selectively assembling said structural members to form an interface frame having at least two sections, one section defining a toilet position, the other section defining a lavatory position; selectively assembling a drain-waste-vent pipe system for the powder room; installing the drain-waste-vent pipe system within the interface frame to form a drain-waste-vent interface unit for the powder room; installing a drain-waste-vent pipe unit substantially vertically in a wet wall of a room section of a building structure; installing a modular pre-dimensioned toilet bowl against the interface frame unit; installing a modular pre-dimensioned cabinet against the interface frame unit to define a lavatory section of the room; installing a modular wash bowl on the cabinet; installing a modular pre-dimensioned medicine cabinet on said interface frame unit at said lavatory section, the cabinet having lighting means attached thereto; providing electrical power from said building power supply to the lighting means; and supplying water to the fixtures by connecting water supply conduits from the water supply of said building to the fixtures.

The method of assembling the bathroom of the present invention further comprises: selectively assembling structural members to form an interface frame bathtub section; installing a modular pre-dimensioned bathtub within the room at the bathtub location of the frame unit; installing a first finished pre-dimensioned shower wall surround over the forward portion of the bathtub; installing a second finished pre-dimensioned shower wall surround over said bathtub in adjacent relation to the first wall surround and interlocking the adjacent end portions thereof to maintain them securely in position; installing a third finished pre-dimensioned shower wall surround over the rear portion of said bathtub and connecting the end portion adjacent the second surround with the end portion of said second wall surround; installing a water supply spout in a manner to extend a portion thereof through the first wall surround and attaching the spout to the interface frame unit to secure the wall surround in position; installing an escutcheon having a securing member by extending the securing member through the first wall surround and connecting the member to an attachment member attached to the bathtub section of the interface unit to further secure the first shower wall surround; installing a shower head having a water supply pipe and bracket means by extending the bracket means through the first shower wall surround and connecting the shower head to a water supply pipe; and installing a shower curtain rod between the first and second wall surround to maintain the positions of the wall surround so as to form a finished shower enclosure.

DETAILED DESCRIPTION OF THE PREFERRED EMBODIMENTS

Figure 1:
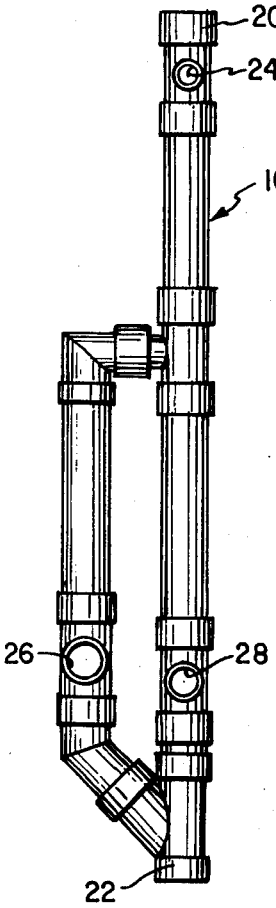
FIG. 1 is a view of a Drain-Waste-Vent Pipe unit (DWV Stack) intended for use with the present invention.

In the following description, the expression "Powder Room" contemplates a water closet, toilet and the like, while the expression "Bathroom" contemplates a full bathroom which may include a powder room and bathtub section — with or without a shower — in combination.

The invention is comprised of five modular basic elements, segregated according to function. Each element contains one or more prefabricated components and each component can be factory assembled to various degrees of completion, at option. Accordingly the degree of in-field assembly can be varied as economics or local labor practices require. The five basic elements are:

1. The Drain-Waste-Vent pipe unit (DWV Stack) 10.
2. The wall surface interface frame 12 of the interface unit 30.
3. The bathtub/shower section 14.
4. The toilet section 16.
5. The lavatory section 18.

Referring to FIG. 1 there is illustrated a drain-waste-vent pipe unit 10, sometimes referred to as a DWV Stack. The drain-waste-vent pipe unit is an assemblage of drain-waste-vent pipes and fittings which are conventionally connected to the drain-waste-vent system of the building structure at end portions 20 and 22 and contains a drain waste and venting configuration as shown. It is installed in the piping chase of the "wet wall" of a room section of the building.

According to normal practice, installation of this stack is generally accomplished at the time the rough plumbing of the building is installed with the only particular requirement being that the drain-waste-vent pipe unit is properly positioned in relation to the finished floor line and with a selected wall of the bathroom of powder room. This positioning is generally accomplished by means of a jig (not shown) and assures proper connection with the piping components of the system at the three open positions 24, 26, and 28. The drain-waste-vent pipe unit 10 may be either factory of field assembled but must conform to specific dimension requirements to insure proper interconnection with the piping components of the drain-waste-vent piping system associated with the room and the building structure.

Certain variations of the drain-waste-vent pipe unit may be required for different applications. For example, one version of the type shown in FIG. 1 is intended to be used with a single bathroom or powder room. A second version may be used for back-to-back bathrooms or powder rooms where interconnections must be made to pipe components on both sides of the "wet wall" or piping chase as will be seen in the description which follows. These multiple pipes are generally intended for structures such as high rise buildings in which powder rooms or bathrooms are positioned in back-to-back relation. However multiple installations would naturally require larger diameter vertical pipes to accommodate proportionately higher volume of waste.

Figure 2:
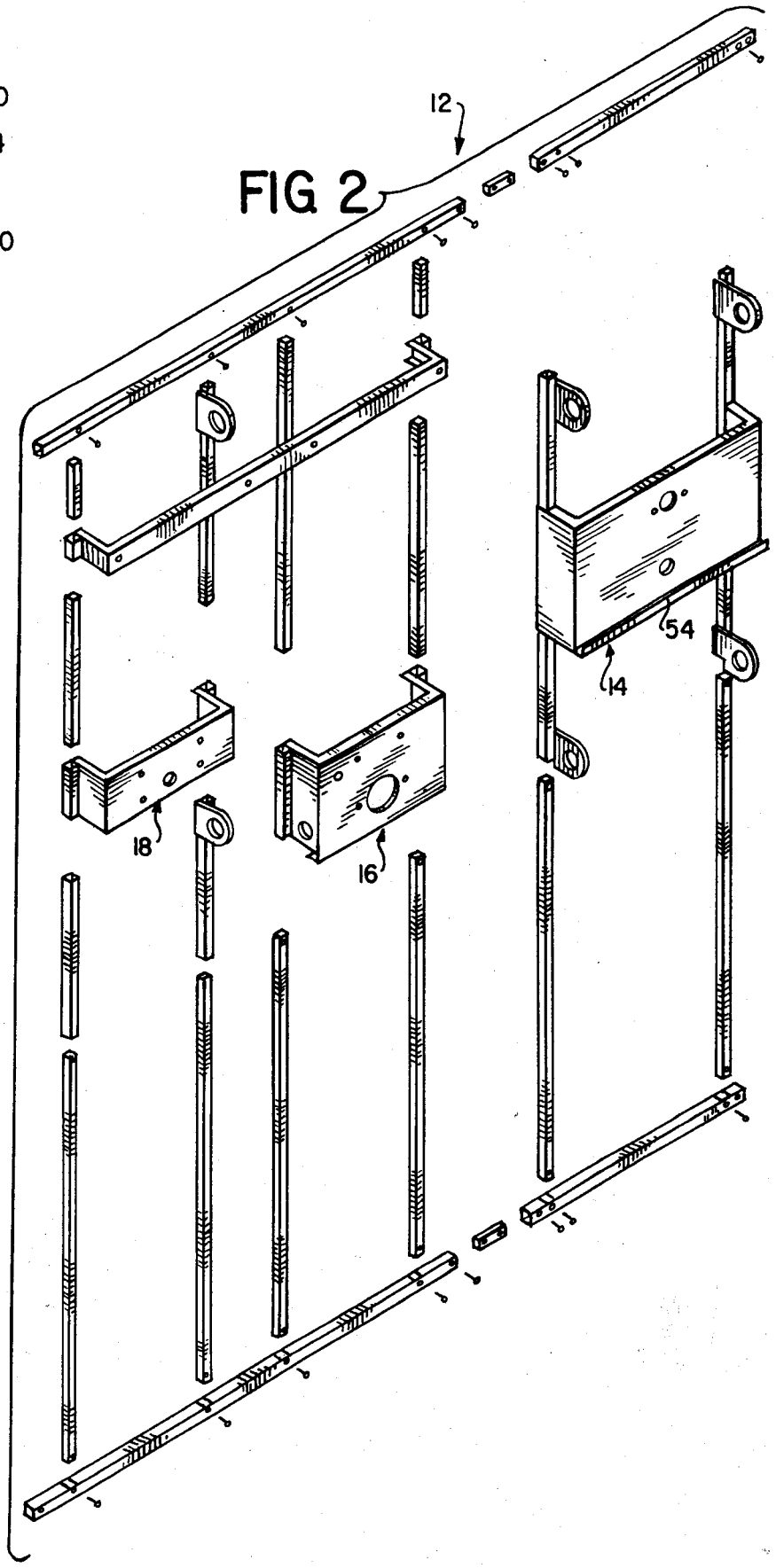
FIG. 2 is a perspective view of the components forming an interface frame intended for selective assembly and use as the frame of the piped interface unit of the present invention.
Figure 6:
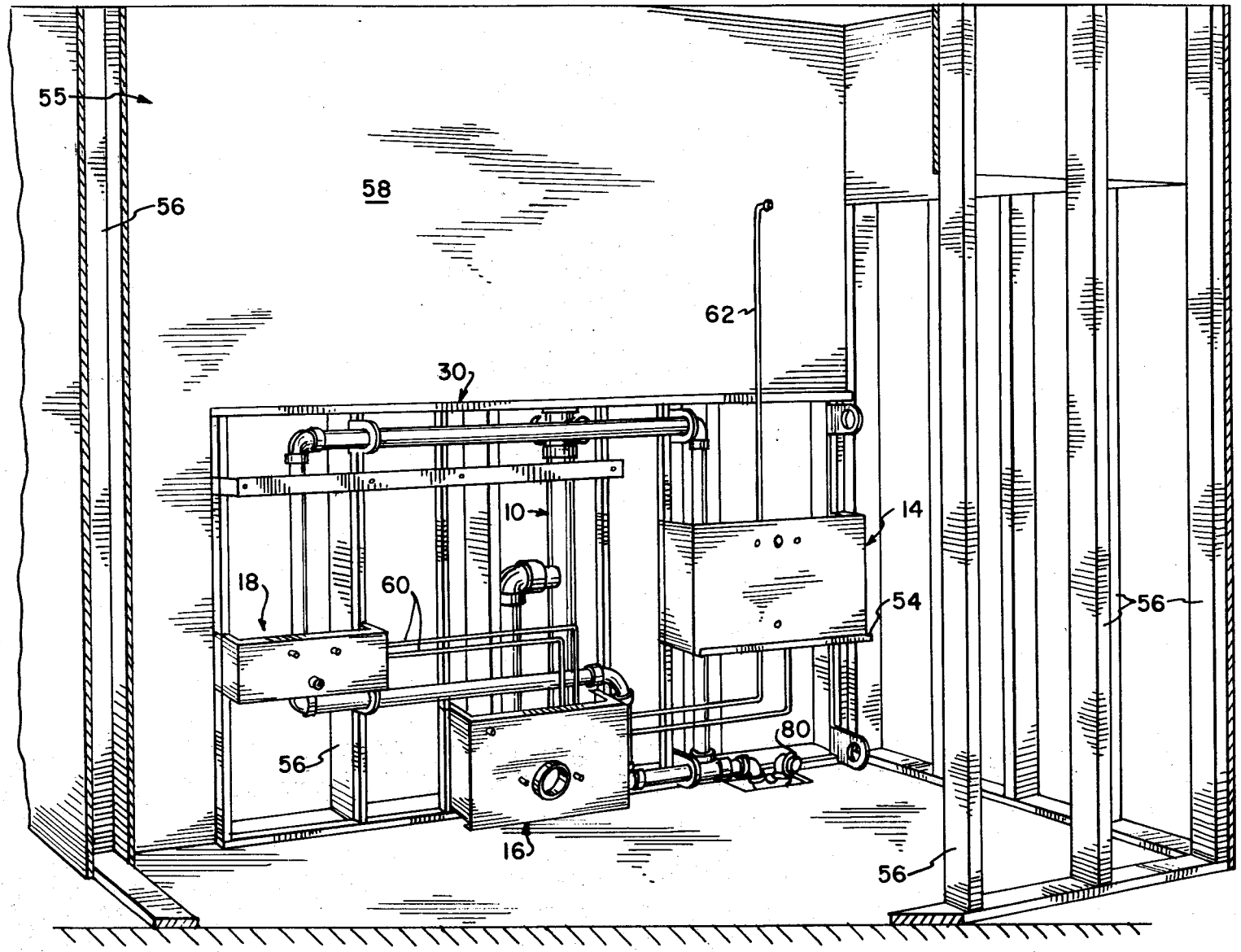
FIG. 6 is a perspective view of the room of FIG. 5 with the interface unit, Drain-Waste-Vent pipes, and water supply lines secured in position.

Referring now to FIG. 2 there is shown the component frame members and brackets of a structural unit 12 which upon assembly, form an interface core structure which supports the drain-waste-vent pipe unit and the drain-waste-vent piping system associated with the room. The interface structure is comprised of three major elements and forms the basic template for a full bathroom when assembled and installed in a room as shown in FIG. 6. The three major elements shown in FIG. 2 comprise templates 14 for the bathtub section, 16 for the toilet section, and 18 for the vanity sink section. Alternately, by merely eliminating the bath section, the basic interface core provides a template for a powder room.

The interface frame sections are rigid members which may be factory assembled or assembled in-situ to form a planar frame to conform it to the particular requirements of a specific installation. The conponents of the structure are preferably fabricated of a metal such as steel, iron, brass, etc. However, the frame may be of plastic materials since most of the in-room elements are floor supported and the only strength required in the frame must be sufficient to support the interface piping and to secure the positioning of in-room elements. The elements of the frame structure may be secured together by threadedly engaging the components, or by bolts, screws and the like, but are preferably assembled by telescoping the sections and securing them with screws, bolts, clamps, etc. or by a snap-together arrangement.

Figure 4:
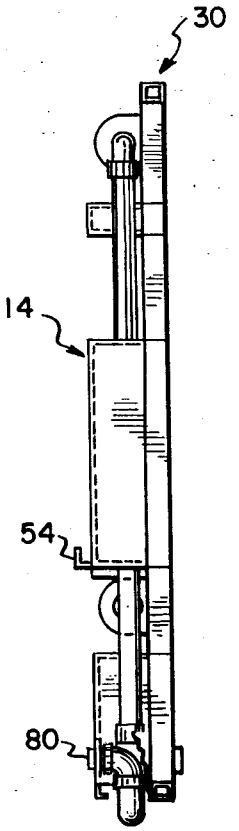
FIG. 4 is a side view of the interface unit of FIG. 3.
Figure 3:
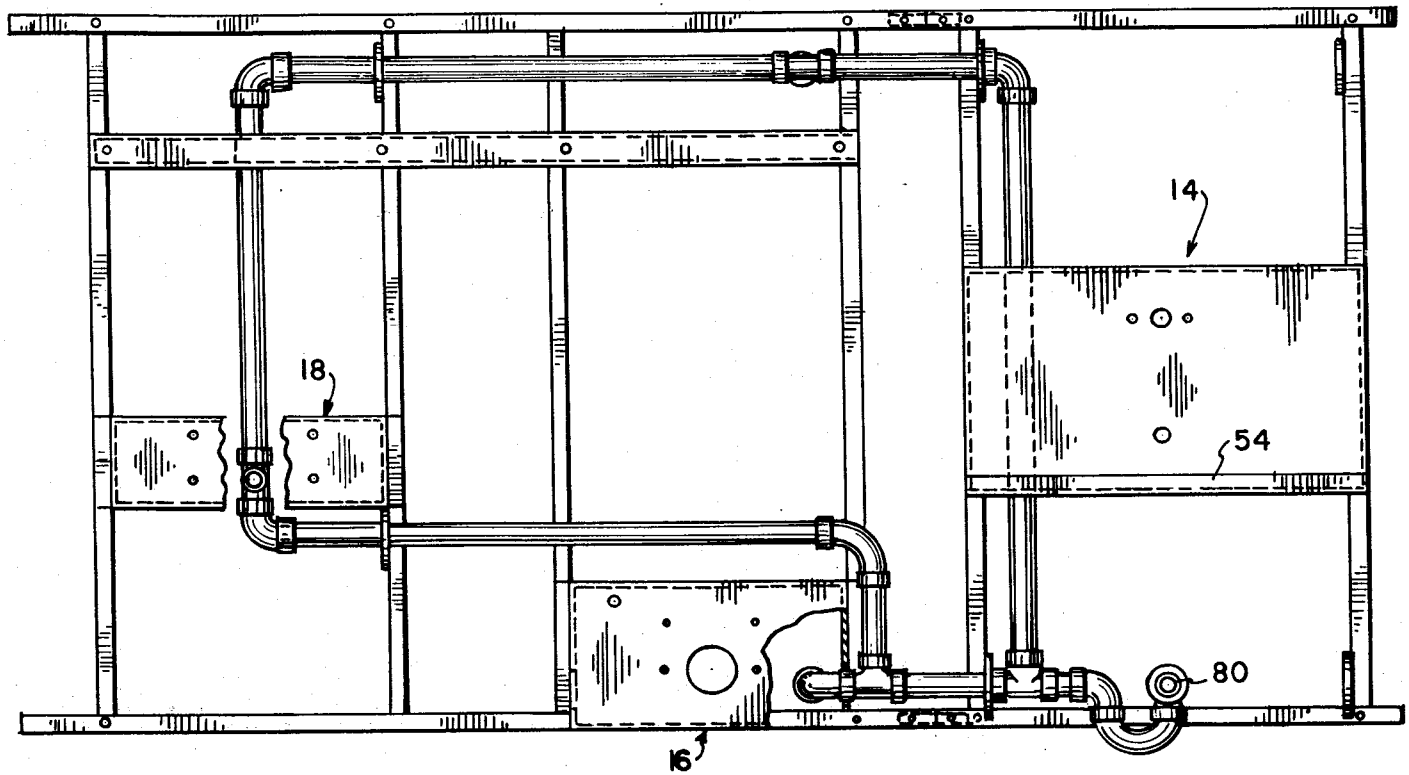
FIG. 3 is a view of an assembled interface unit with the Drain-Waste-Vent pipe system installed as intended for use with a full bathroom of the present invention.

Referring now to FIG. 3 the structural interface frame 12 of FIG. 2 is shown in assembled form 30 with the drain-waste-vent piping system 32 through 52 secured in position. The assembly shown in FIG. 3 is suitable for use in a full bathroom (ie. bathtub section, toilet section and vanity sink section). As can be seen in the drawings, the drain-waste-vent interface unit 30 provides a convenient layout of the bathroom of powder room with dimensions conforming to the requirements of the particular room in which the installation is to be made. FIG. 4 is a side view of the interface unit of FIG. 3 and illustrates a bathtub support 54 which supports the forward portion of the bathtub as will be seen in the description which follows.

Figure 5:
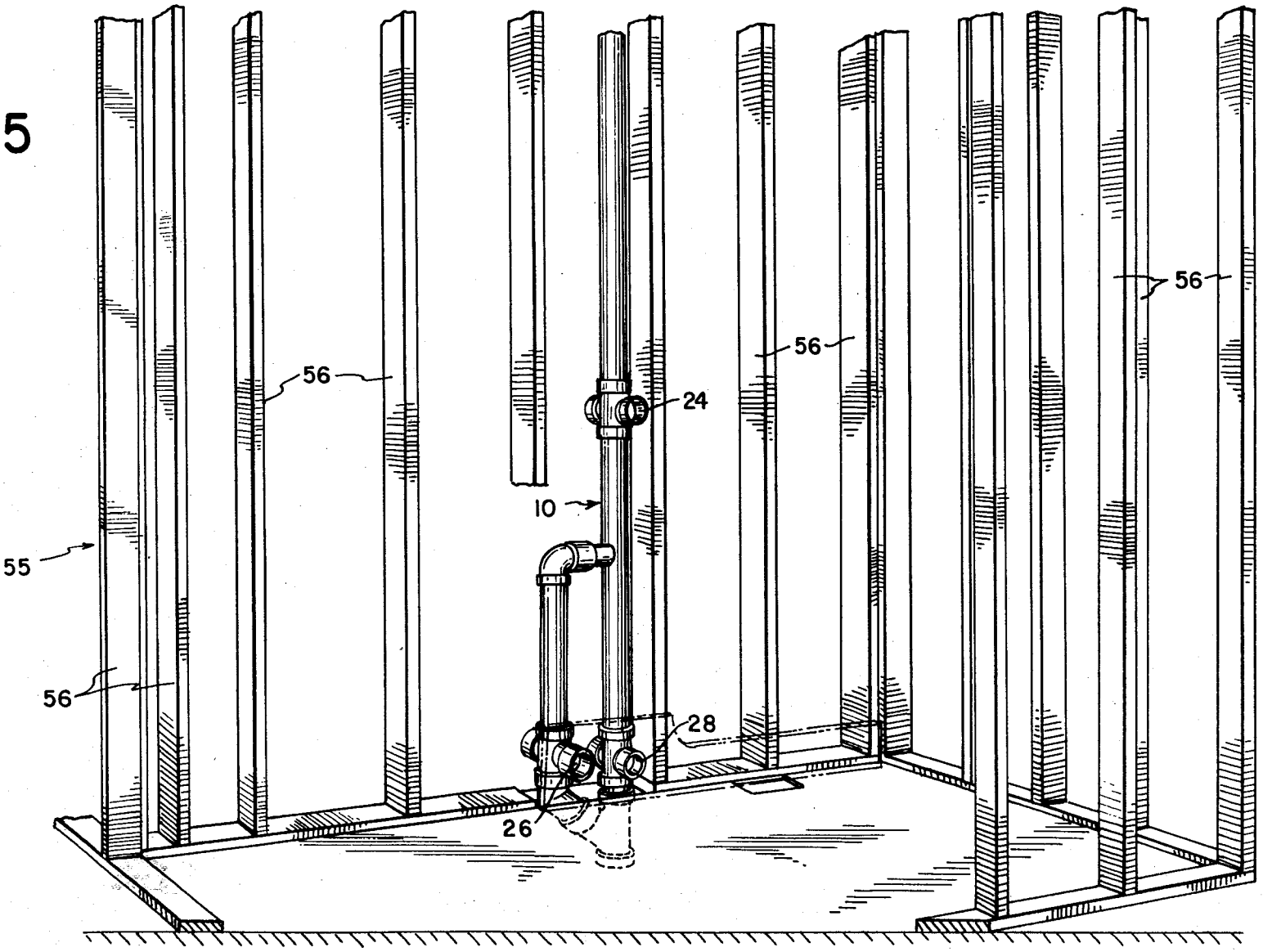
FIG. 5 is a perspective view of a basic room section of a building structure with the Drain-Waste-Vent pipe unit of FIG. 1 installed in position and connected to the Drain-Waste-Vent pipe system of the building.

Referring now to FIG. 5 there is shown an unfinished room 55 framed with studs 56 in which the drain-waste-vent pipe unit 10 of FIG. 1 is installed and connected to the drain-waste-vent piping chase of the wet wall of the room section of the building structure. The drain-waste-vent pipe unit must be positioned with the "wet wall" of the building as shown — prior to any other installations — the dimensional position requirements with respect to the finished room strictly adhered to as previously noted.

Referring to FIG. 6 there is illustrated the room 55 of FIG. 5 with the interface unit 30 of FIG. 3 floor supported and installed in adjoining relation to the wet wall 58. It is secured to the "wet wall" by conventional securing means such as nails, screws, etc., preferably with the bathtub end of the frame in contact with the tub wall studs or rough wall. This assures proper alignment of the three interconnections between the interface piping and the drain-waste-vent pipe unit. For a powder room only, the interface unit will be secured in contact with the lavatory wall at the toilet end in which case proper alignment of the two interconnections will be assured. Water supply lines 60 are installed and a shower riser pipe 62, if required, is positioned adjacent the bathtub bracket 14 of the interface.

A feature of the present invention resides in the capability of installing interface unit 30 — or even the entire powder room or bathroom — in position against the "wet wall" after the upper portion of the walls of the room have been completed and finished (painted, wallpapered, etc.). The interface unit, being a surface mounted pre-piped unit — which is not required to be integrally assembled as part of the basic structure of the room — is thus suitable for original or prime installations or for powder room and bathroom conversions.

The connections between the pipes and the drain-waste-vent pipe unit 10 are preferably of the type generally used with the pipes selected in a particular installation. For example, the pipes may be comprised of brass, iron, etc. Accordingly, the pipe connections will be unions, elbows and the like, of iron or brass. Copper pipes will be connected by connecting means generally used with such members such as sweated joint connections. Also the hot and cold water supply lines 60 to each fixture may be of the type generally used according to local practice. For example, these lines may be the form of copper tubing sweated to the supply piping of the system.

Referring further to FIG. 6, an electrical junction box 66 is provided as part of the lavatory portion of the frame. This permits interconnection between the building wiring 68 and the room lighting, which — as will be seen — is attached to a medicine cabinet component of the modular lavatory section. Wiring 70 from the junction box 66 extends to an electrical recepticle 72 located at the top center of the lavatory section of the interface frame.

After completion of the installation as illustrated in FIG. 6, the basic plumbing system is complete and in those geographical locations in which local rules may require, the plumbing (local or other) inspector may inspect and perform the necessary tests of the system with complete access to all components, connections and joints. Thus in the event further work is required to comply with local codes and practices, this may be detected and corrected prior to proceeding further.

The bathtub/shower section is comprised of four major components: the bathtub and a three-piece wall surround. The bathtub is a free standing, floor-supported unit with a factory fitting overflow drain assembly. It is so configured that it can be brought into a finished (or a partially finished) room, placed in position against the tub wall and the face of the interface unit bracket 54, and then lowered to the floor.

Figure 7:
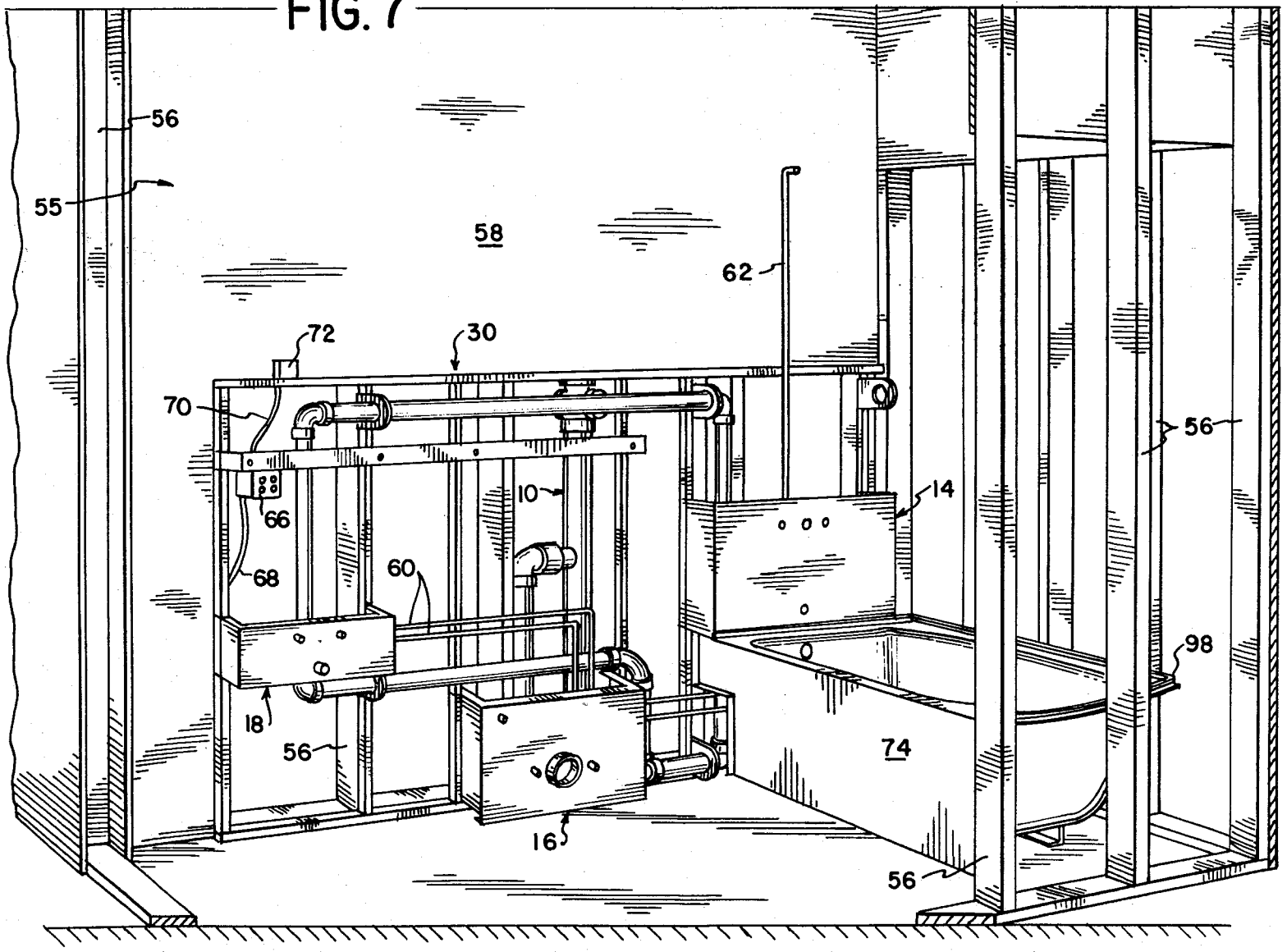
FIG. 7 is a perspective view of the room of FIG. 6 illustrating the bathtub of the present invention in position.

FIG. 7 illustrates the installation shown in FIG. 6 with the bathtub 74 of the present invention installed into position. The installation of the modular bathtub 74 of the present invention is peculiarly applicable to the present system as will be described in connection with FIGS. 8 and 9. The bathtub 74 is positioned by the interface unit and secured in position by the three-piece wall surround. The forward portion 76 of the tub 74 engages the lip 54 of bracket 14 of the bathtub section of interface unit 30.

Figure 8:
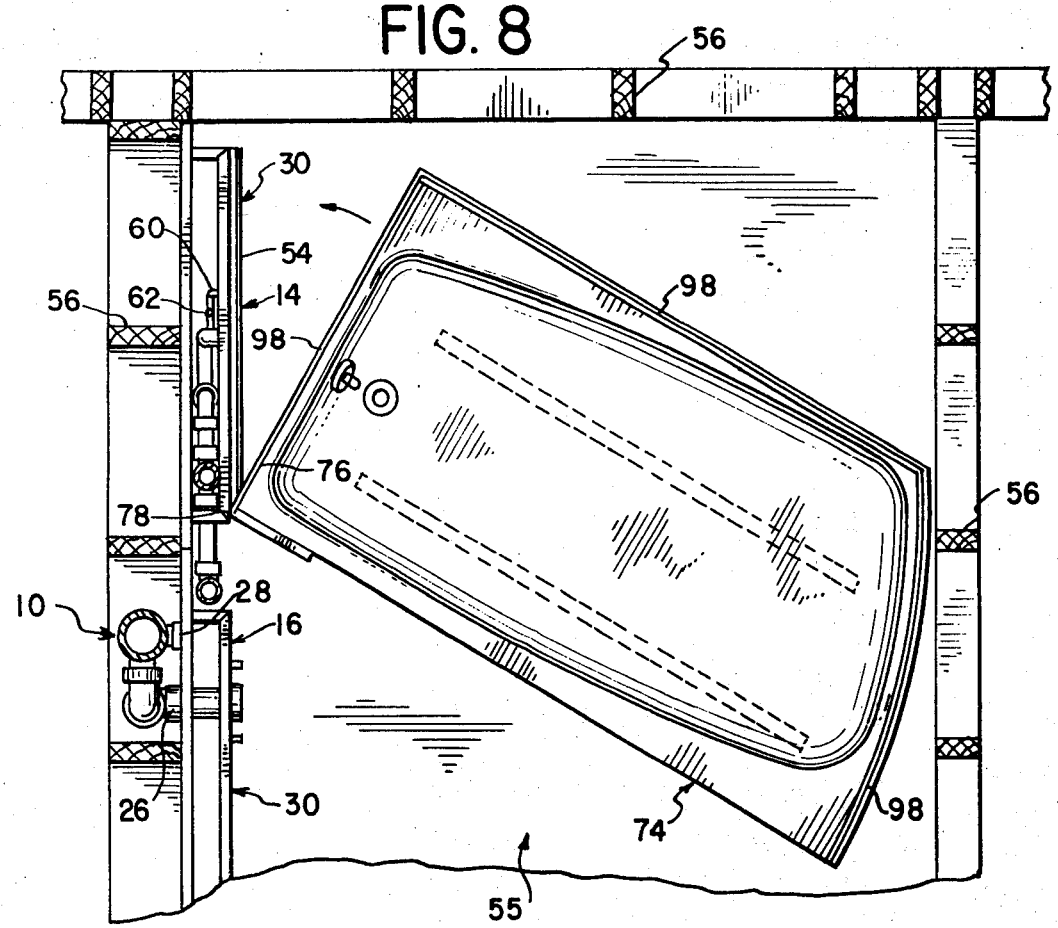
FIG. 8 is a top view of a portion of the room of FIG. 7 illustrating the installation procedure intended for use with the bathtub of the present invention.

The bathtub 74 shown in FIG. 7 is uniquely configured to have an elongate configuration with one arcuate end portion as shown. It may be constructed of conventional materials such as enamel iron, enameled steel, plastic materials, and the like. Preferably the bathtub will be approximately 16 inches high so as to permit it to pass through a standard doorway 2 feet in width. It is approximately 30 inches wide in accordance with established standards for residential bathrooms and it is approximately 55½ inches long and particularly configured to have a radiussed arcuate configuration along one of the shorter sides as shown in FIG. 8. The center of the radius of the arcuate side of the bathtub is preferably located approximately at the lower left hand corner portion 78 of forward portion 76 of the bathtub as shown in FIG. 8. With this configuration the bathtub can be simply fitted into the room after all heavy plumbing and structural work has been completed and then rotated snugly into position in the bathtub end of the room structure and supported on hanger rails 58 as shown in FIG. 7. Thus with all structural and plumbing work completed prior to its installation, the risk of damage to the finished surface of the bathtub is minimized. This risk was generally substantially great in prior art installations during the performance of the structural and plumbing work in the room. For the same reasons the risk of damage to the remaining modular fixtures of the present invention is substantially eliminated.

Figure 9:
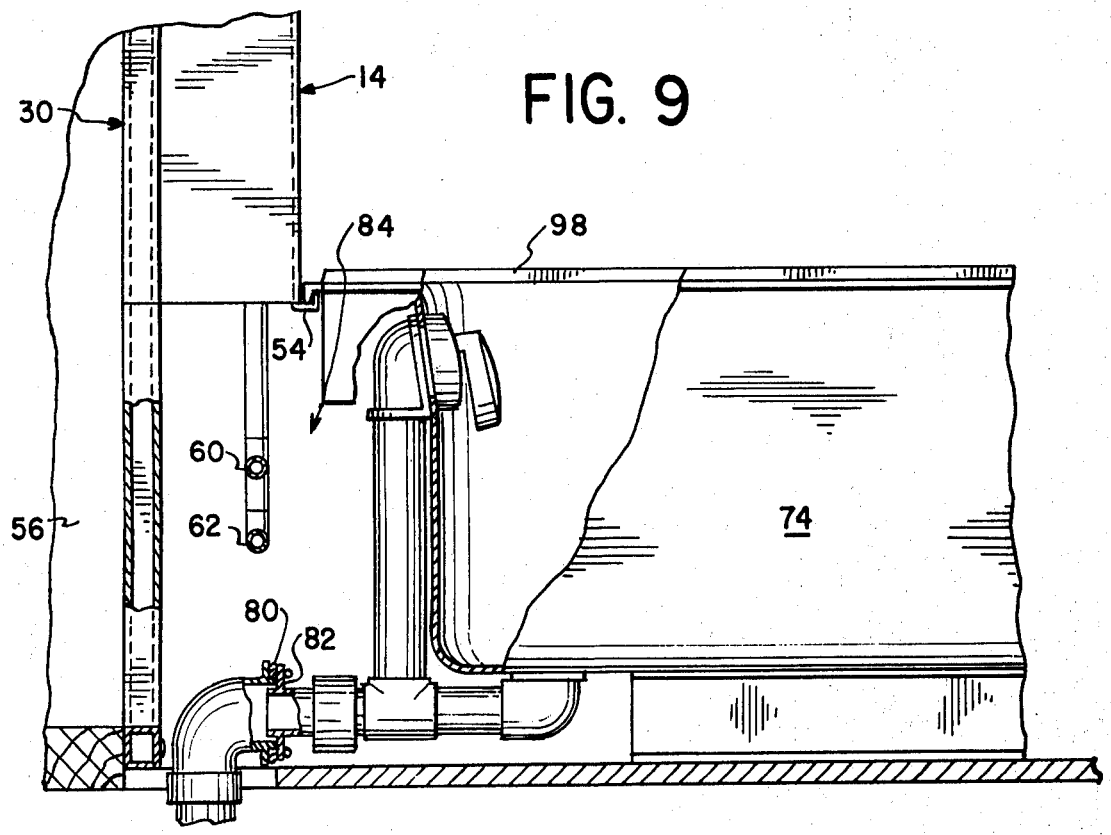
FIG. 9 is a side view of the forward portion of the bathtub of FIG. 8 partially in cross section, illustrating the tub drain pipe connection with the interface unit of the present invention.

Referring now to FIG. 9 there is illustrated a side view of the lower forward end portion of the bathtub in which the bathtub drain fitting is connected to the drain-waste-vent system of the room. While it is preferred that the drain connection 80 is accomplished by a quick-connect clamping unit 82, since certain local codes will not permit them, it is also contemplated within the scope of the present invention to connect the drain system of the bathtub by conventional means such as threaded pipes, unions, etc. (not shown). The opening 84 defined by the forward left-hand side wall of the bathtub 74, is later covered by a shroud section of the modular toilet bowl as will be seen. The bathtub may be provided in left and right-hand versions to accommodate installations as shown, or installations having a "mirror image" of the installation shown.

It is clear that the modular aspects of the present bathtub provide particular convenience in the installation, repair and/or replacement thereof. Also, the combination of the wall surface mounted interface unit 30, and the bathtub 74 may be installed within several hours thereby avoiding the high costs of labor which were normally incurred during comparable installations of the prior art. The forward open position of the bathtub of the present invention permits ready access for repairs as contrasted to prior art bathtubs in which leaks, for example, were generally so difficult to repair — due to the inaccessibility of the drain supply connections to the tub — that often the cost approached the cost of a new bathroom.

Figure 10:
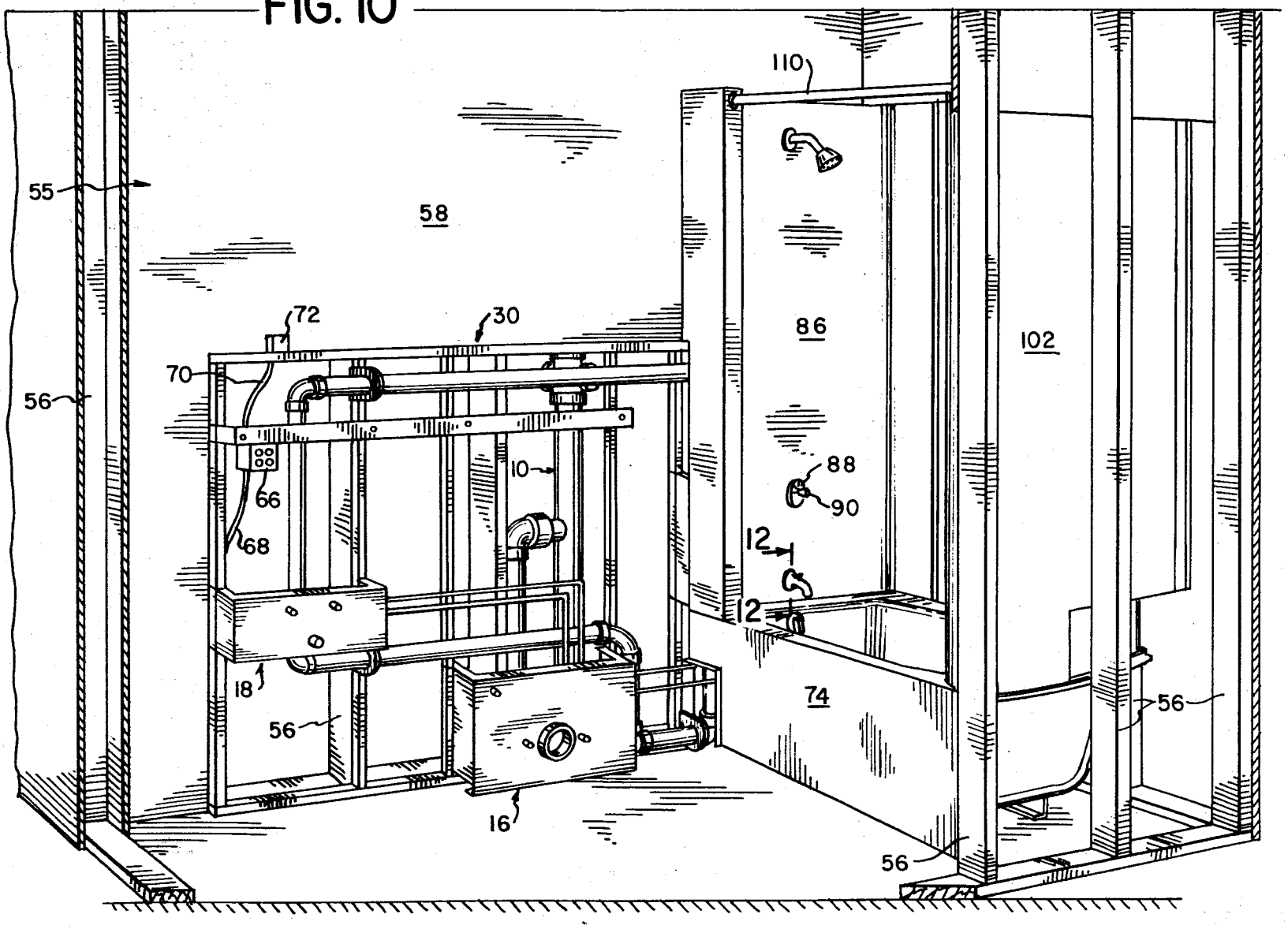
FIG. 10 is a perspective view of the room of FIG. 9 with the bathtub/shower wall surround members secured in position.
Figure 11:
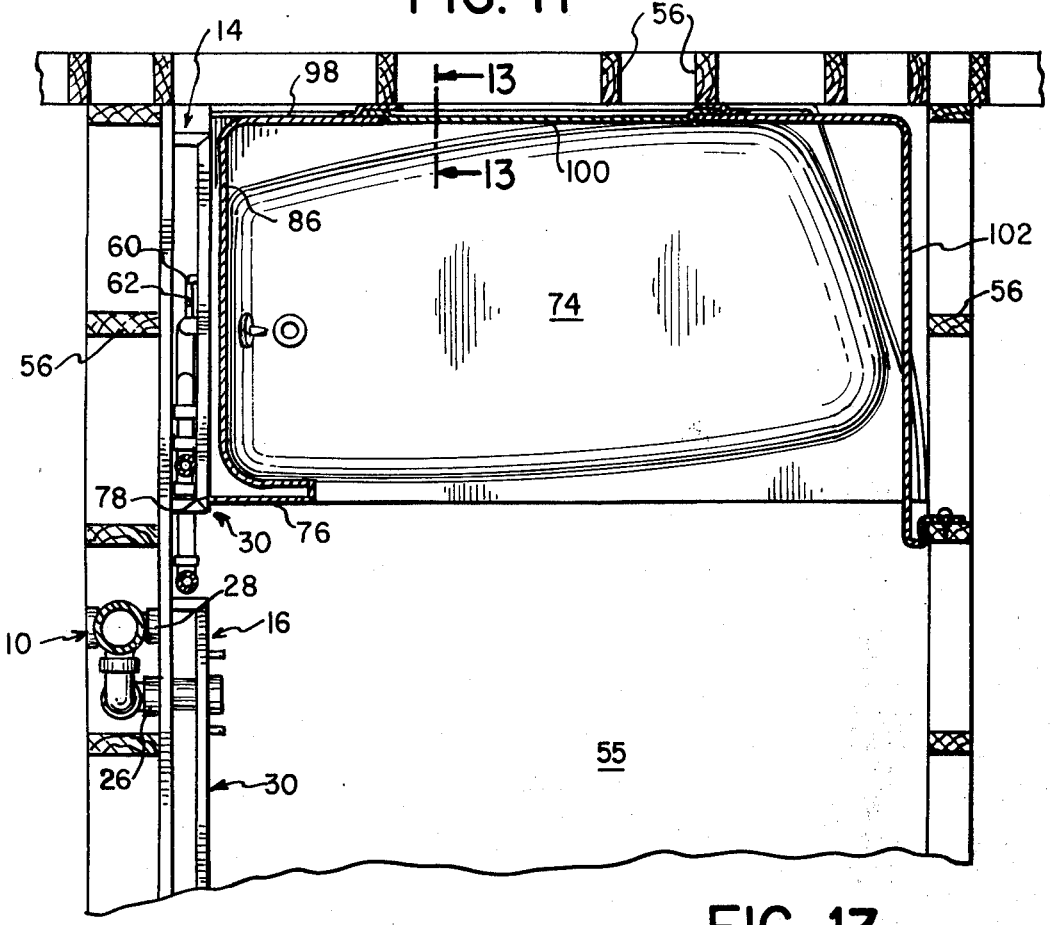
FIG. 11 is a top cross sectional view of the tub and wall surround section of the room of FIG. 10.
Figure 12:
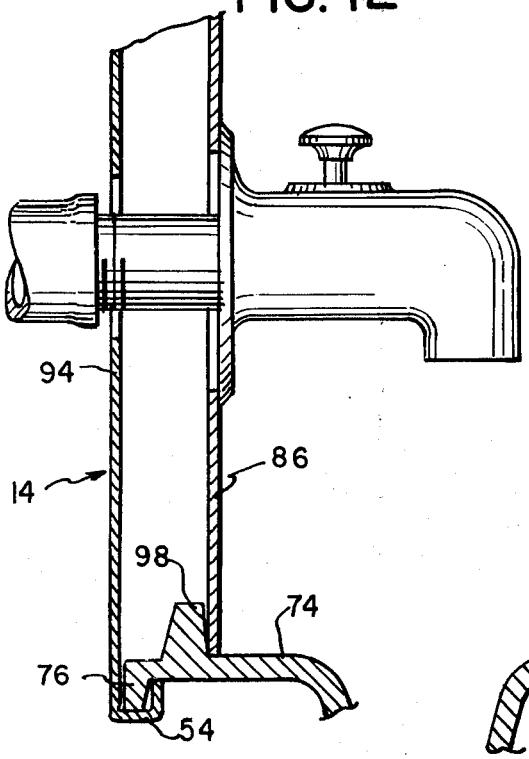
FIG. 12 is a view taken along lines 12—12 of FIG. 10.
Figure 13:
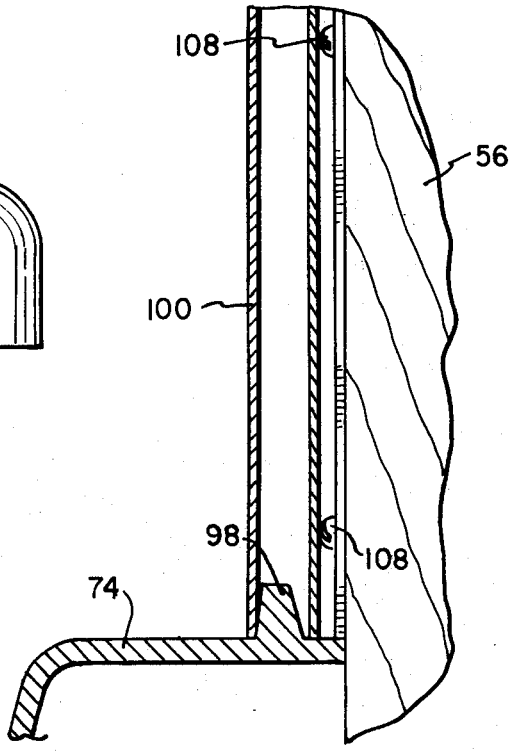
FIG. 13 is a view taken along lines 13—13 of FIG. 11 illustrating the method of securing a bathtub/shower wall surround member in position.

In FIG. 10 there is illustrated, the bathroom shown in FIG. 9 with the first wall surround panel member 86 secured into position over the forward portion of the bathtub. The panel 86 is preferably secured in position by the shower head 62 which is threadedly engaged into the riser pipe system behind the panel in a manner which secures the panel against the structure as shown in FIG. 12. Further securing of the wall surround 86 may be accomplished by rotating the threaded escutcheon 88 surrounding the shower-tub water supply lever 90. The escutcheon 88 is threaded into a bathtub bracket attached to the interface frame 12 of interface unit 30 (not shown). Referring further to FIG. 12 there is illustrated a unique "tongue and groove" feature of the wall surround member 86 whereby the lower portion is spaced from the lower portion 94 of the bathtub/shower section 14 of the interface unit 12 to define a slotted lower portion surrounding a lip (or ledge) 98 of bathtub 74. The ledge 98 engageably enters the slot defined by the lower portion of the surround to create a "water barrier" in the form of a water-tight seal about the periphery of the bathtub and acts to secure the bathtub in proper position, as described in connection with FIG. 7. Referring now to FIG. 13, the interconnection between the second shower wall surround member 102 is secured in position similarly to wall surround member 86. The third wall surround member 100 is positioned by a "tongue and groove" arrangement similar to the other wall surround members and the three wall surround members are locked in attached relation by "tongue and groove" arrangements at 104 and 106.

While the wall surround members 86, 100 and 102 are partially secured in position against the studding or interface frame by screws or other fasteners 108 shown in FIG. 13, the final securing is accomplished by positioning a shower curtain rod 110 in position as shown in FIG. 10. The shower curtain rod is preferably adjustable in length such that it can be predimensioned to cause the wall surround members 86 and 102 to be secured in position while providing adjustments for minor dimensional variations in the studded walls. Also, the tongue and groove interlocking system between wall surround members 86 and 100 and members 100 and 102 as described, securely maintain the relative positions of these members.

It can be seen that at this point the basic components of the bathroom are assembled in predimensioned relation. The wall surround members 86, 100 and 102 are uniquely locked into position as described, while providing a water tight seal along the periphery of the tub. The wall surround components may also be provided in right or left-hand versions.

Figure 14:
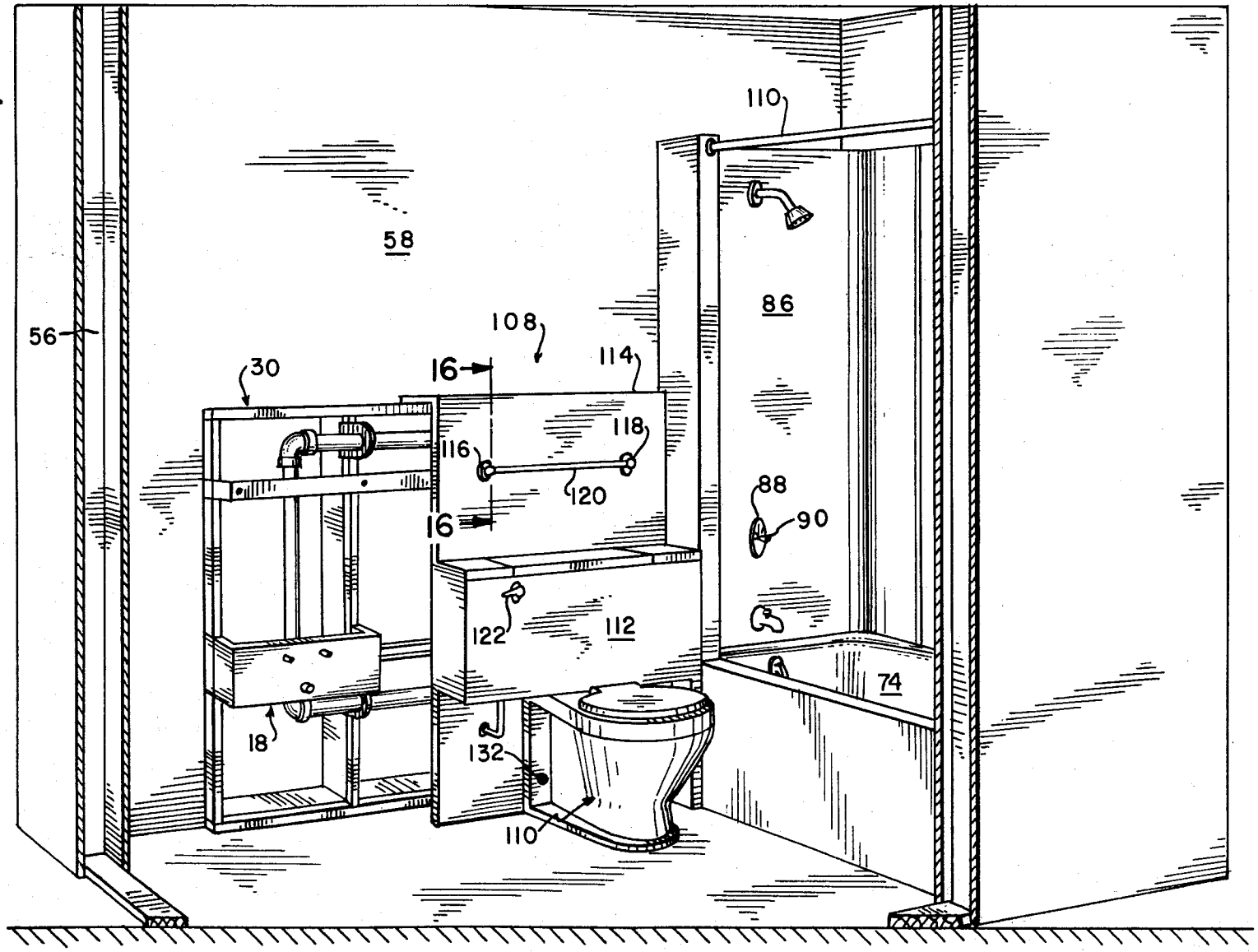
FIG. 14 is a perspective view of the room of FIG. 10 with the toilet bowl and flush water tank shroud installed in position.
Figures 15, 16:
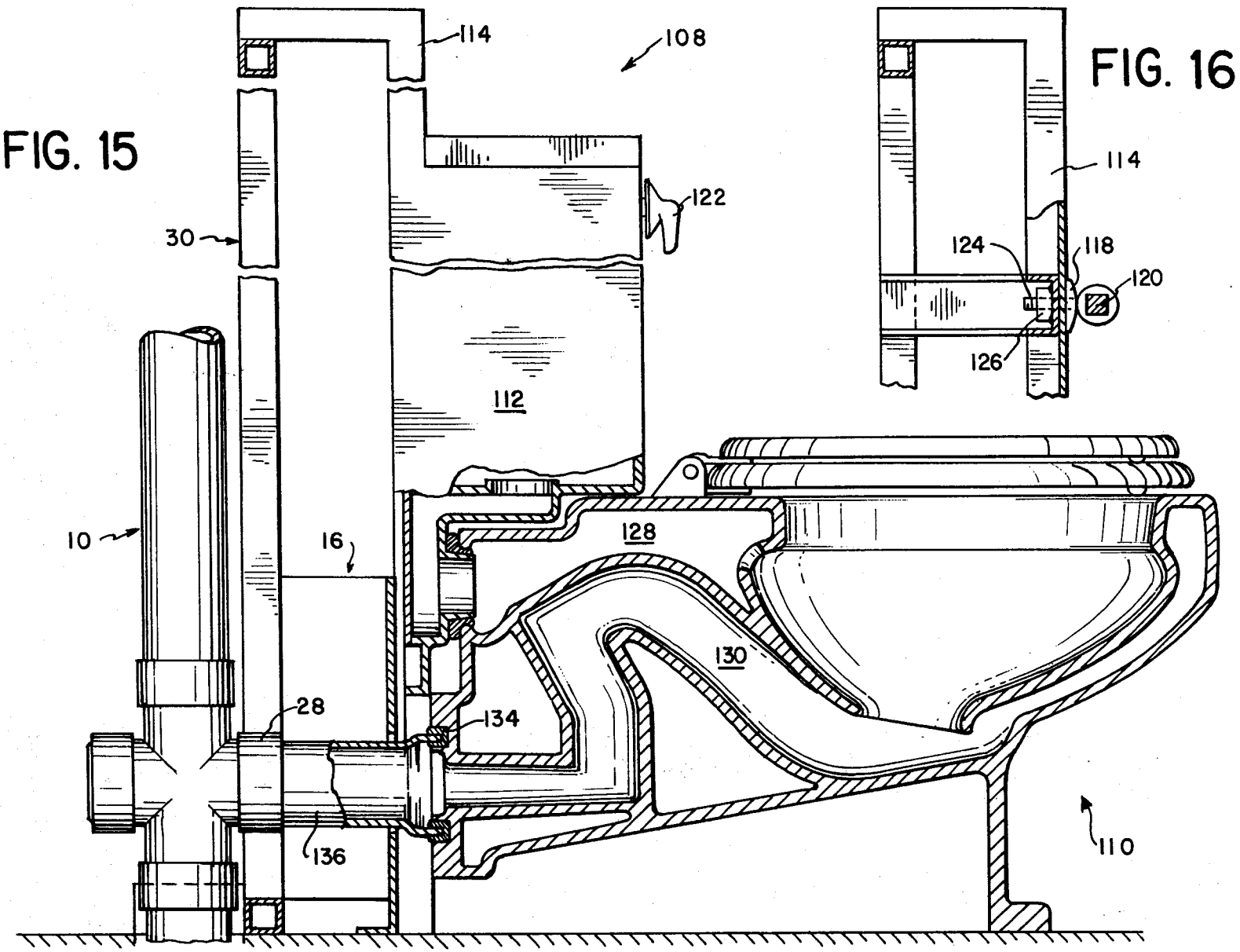
FIG. 15 is a partial cross sectional view of the toilet bowl of the present invention illustrating the unique inlet and outlet features and single step rear mounting feature.
FIG. 16 is a view taken along lines 16—16 of FIG. 14 illustrating the toilet shroud attachment of the towel rack installed according to the invention.

FIG. 14 illustrates the bathroom shown in FIG. 10 with the toilet section 108 installed in position and toilet bowl 110 connected with the drain waste and water supply system by pipping means shown in FIG. 15. Water tank 112 is mounted to the interface unit 30 by an associated integral shroud unit 114 which is prefabricated, floor supported, and secured into position by means of towel bar brackets 116 and 118 as shown in FIG. 14. Towel bar 120 is mounted to these brackets. The brackets 116 and 118 have securing means 124 which extend through the shroud 114 and are attached by suitable attachment means such as nuts 126 to secure the toilet section in position against interface unit 30. The flush tank 112 is supplied with a conventional flush valve 122 and control valve and flushing actuating mechanism (not shown).

A unique feature of the toilet bowl 110 of the present invention is clearly illustrated in the cross-sectional view of FIG. 15. By the provision of internal flush water and waste channels 128 and 130, respectively — which extend toward, and are opened to, the rearward face of the toilet bowl unit — it is now possible to secure the toilet bowl for tank-type or pressure-type (commercial) flushing in a single step mounting operation. The toilet bowl 110 is floor-supported and mounted in adjacent relation and abutting with the shroud 114 of the toilet section. The bowl 110 is secured in position by merely threading two bolts 132 (one bolt not shown in FIGS. 14 and 17) sufficient to secure the bowl 110 in position. Referring once again to FIG. 15 an outlet seal ring 134 of a bees wax-type is positioned between the outlet channel 130 of the toilet bowl and the waste pipe 136 which completes the waste line from the bowl to the drain-waste-vent pipe unit 10 through outlet 28. Thus by the provision of a rear water flush-rear waste outlet tank-type toilet bowl, it is possible to install the toilet bowl in position in a single attachment step thereby avoiding unnecessary and expensive labor costs generally incurred in installing systems of the prior art. A conventional toilet seat 138 may be provided is shown in FIG. 14.

Figure 17:
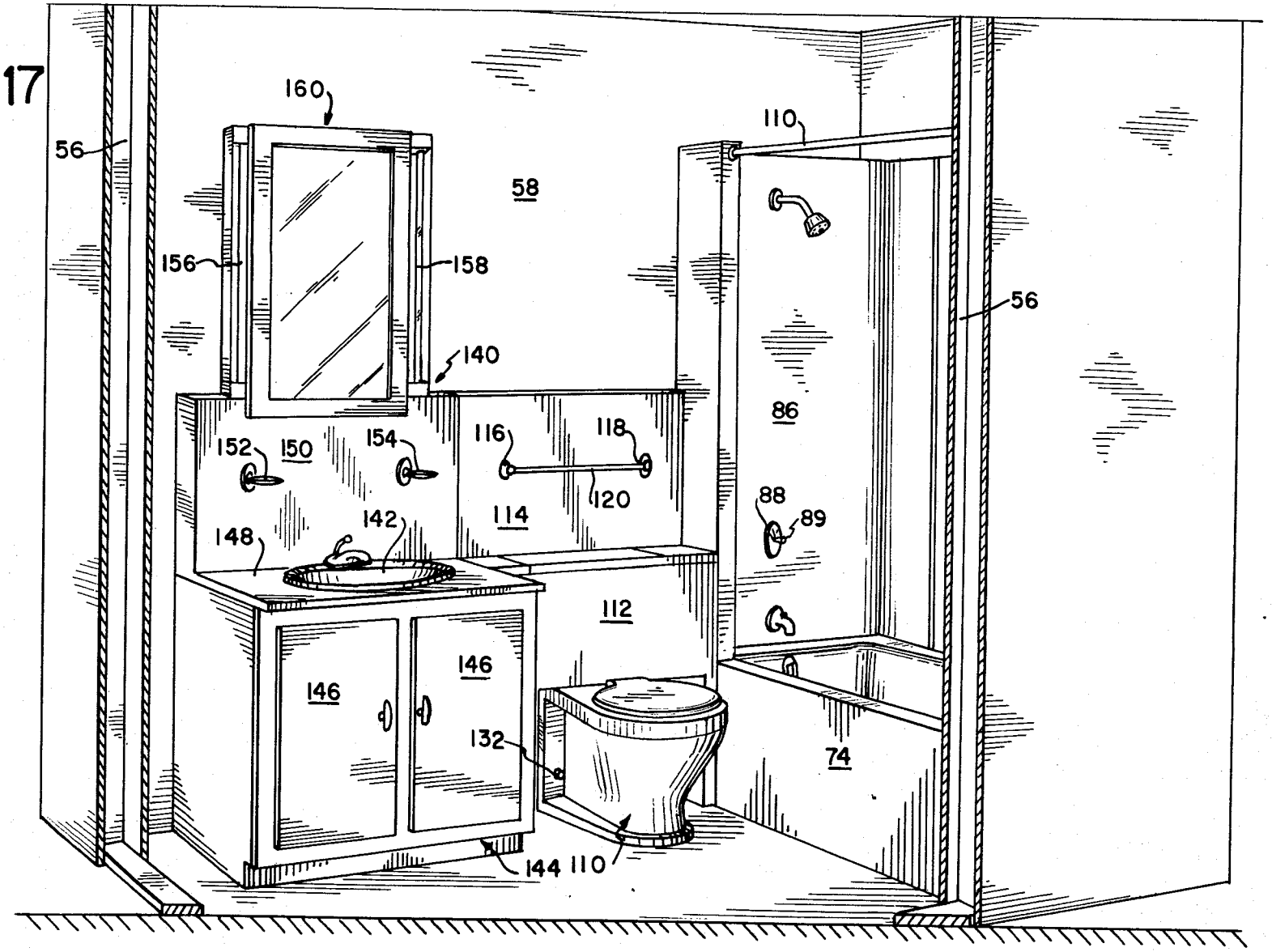
FIG. 17 is a perspective view of the completed bathroom of the present invention with the vanity sink and mirror installed in position.

Referring now to FIG. 17 there is illustrated a perspective view of the completed bathroom of the present invention. The lavatory section 140 included wash basin 142 secured within a full standing vanity cabinet 144 having doors 146 and a lavatory counter top 148. An upper interface shroud 150 is connected to the counter top 148 and is securely mounted to the vanity section as shown and is secured against the interface core unit by decorative accessories such as by threadedly attaching a soap dish 152 and glass and tooth brush holder 154 threaded into the interface unit frame behind the shroud in a manner similar to the attachment of the towel bar bracket attachment shown in FIG. 16. A securing member which forms part of these accessories extends through the shroud and is attached to a bracket member which is secured to the frame of the interface unit.

Once the lavatory section is mounted in position, supply and drain interconnections to the interface unit piping system are preferably completed by using quick flexible connectors (not shown) for water supplies and drains, or alternatively, conventional connecting means as may be required by local plumbing codes. Room illumination may be provided by lights 156 and 158 (fluorescent or other conventional types) which comprise part of the medicine cabinet. The modular medicine cabinet 160 is properly positioned on the top ledge of the upper interface shroud 140 and secured to it by means of two bolts or screws. As it is positioned, an electrical plug engages the electrical receptacle 72 previously illustrated for providing power to the lights 156 and 158.

Figure 18:
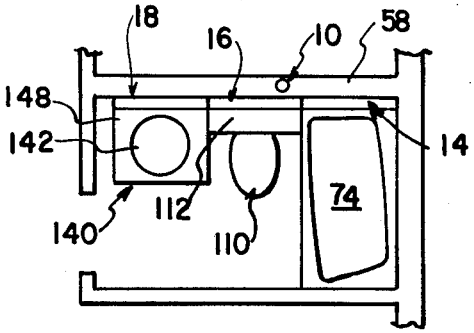
FIGS. 18–21 are views illustrating some of the selective combinations of powder rooms aand full bathrooms which are possible with the present invention.
Figure 19:
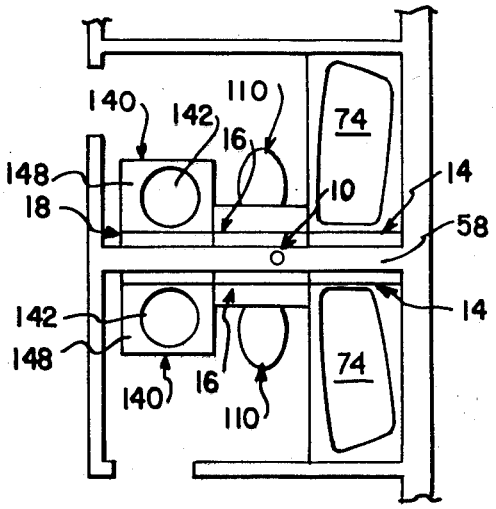
Figure 20:
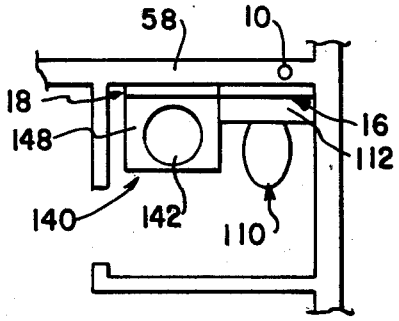
Figure 21:
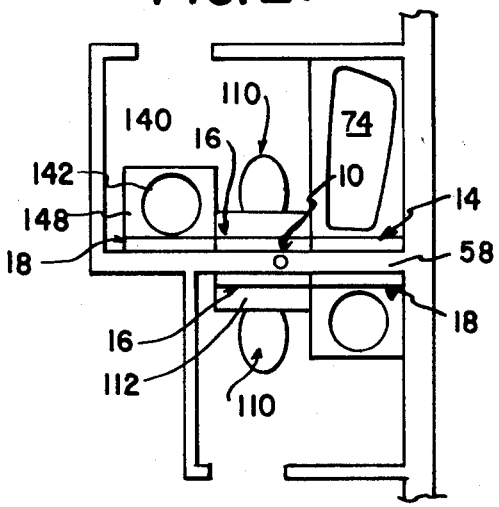

It can be seen from the foregoing description that the modular aspects of the wall mounted interface unit as well as the modular aspects of the fixtures of the washroom or full bathroom make it possible to install a bathroom or powder room in a substantially completed room while reducing the time and labor costs to assemble such facilities. There is illustrated in FIGS. 18 through 21 some of the various combinations and arrangements which are possible utilizing the present invention. Moreover the interchangeable aspects of the components of the present invention make it possible to provide left hand and right hand powder rooms or full bathrooms as shown in FIGS. 18 through 21. In fact, last minute changes from a full bathroom having a tub on the right hand side can be made to convert the arrangement to a full bathroom having the tub on the left hand side by a mere interchange of the tub section of the interface frame and subsequent installations. Further, the tub can be completely eliminated to provided merely a powder room installation. The modular aspects of the present invention facilitate numerous combinations and arrangements of bathrooms, powder rooms and the like which will readily come to the minds of persons skilled in the art. In FIG. 18 there is shown a single bathroom, while in FIG. 19 there is illustrated a single powder room, while in FIG. 21 there is illustrated a full bathroom and a powder room in back-to-back relation.

The versatility and symmetry of the sections of the interface core makes it possible to assemble the modular components of the present invention so as to adapt them to individual needs while the modular aspects make it posible to market the components on a part-by-part basis, or as a complete system. Thus it is now possible to market a powder or bathroom on a cash-and-carry basis while its installation can be completed in a new room or an existing room with a minimum amount of professional plumbing required.

I claim:

1. An assemblage of a plurality of pre-dimensioned and pre-engineered modular units adapted to be assembled to form at least a powder room within a room section of a building structure which comprises:

a. an interface frame adapted to be mounted adjacent to a wet wall portion of the room section, the wet wall portion having a water pipe system extending therethrough and associated with the building water supply, said interface frame being formed of structural frame members dimensioned and configured to be connected in at least one of a plurality of relative positions which define locating positions at least for toilet and lavatory sections;

b. a horizontal support bracket associated with each section defined by said interface frame being connectable to the structural members forming each interface frame section so as to adapt said frame sections to define interface support means at least for modular toilet and lavatory sections;

c. a drain-waste-vent pipe unit adapted to be supported substantially vertically within at least a portion of the wet wall of the room section and adapted to be connected to a drain-waste-vent pipe system of the building structure;

d. drain-waste-vent pipe members adapted to be connected in end-to-end relation and capable of being supported within the interface frame structure to form an interface unit adapted to provide a drain-waste-vent pipe system for the room section;

e. means adapted to connect the vent system of the interface unit to the vent system of the building structure;

f. a modular pre-dimensioned toilet bowl adapted to be supported on the floor of the room section and adapted to be positioned adjacent said horizontal support bracket associated with said toilet section of said interface frame, said toilet bowl defining flush water inlet and waste outlet means at the rear portion thereof;

g. means to secure the rear portion of said toilet bowl to said horizontal support bracket associated with the toilet section of said interface frame and means to connect the waste outlet of said toilet bowl to the waste outlet of said interface unit;

h. a substantially finished shroud member adapted and dimensioned to be selectively removably positioned about at least a portion of said toilet bowl adjacent the toilet section of said interface unit, said shroud member defining a finished wall portion and having means to accumulate flush water therein and control means to selectively release the flush water through an opening defined by a lower portion of said water accumulating means;

i. means to connect the water supply system of the wet wall to said flush water accumulating means to selectively accumulate flush water therein;

j. means to connect the lower opening defined by said flush water accumulating means to the flush water inlet portion of said toilet bowl and resilient means adapted to be positioned within the flush water inlet opening of said toilet bowl and capable of providing a substantially sealed connection between said flush water accumulating means and said toilet bowl;

k. means for supporting towels and the like adapted to be connected to said toilet section of said interface unit in a manner to secure said toilet shroud in adjacent relation with said interface unit comprising:

1. a first elongated member adapted to support towels and the like; and 2. at least first and second support members extending from each end portion of said towel support member and adapted to be extended through the toilet bowl shroud at a location above the toilet bowl position, said first and second support members having means to secure said toilet shroud to said interface unit;

l. a modular cabinet member adapted to be supported on the floor of the room section and to be secured to said lavatory section of said interface unit;

m. a modular wash bowl adapted to be supported on said cabinet member adjacent said lavatory section of said interface unit, said wash bowl having a lower drain outlet means;

n. means to connect the water supply of said wet wall to said modular wash bowl;

o. means to selectively activate and direct water from said water supply to said wash bowl;

p. means to connect the drain outlet means of said wash bowl to the drain system of said interface unit;

q. a substantially finished shroud member adapted to be positioned in adjacent relation against said lavatory section of said interface unit above said cabinet;

r. a dish for soap and the like having fastener means adapted to be extended through said lavatory shroud member in a manner to secure said shroud member to said lavatory section of said interface unit;

s. means adapted to support tooth brushes and the like comprising fastener means adapted to be extended through said lavatory shroud member in a manner to further secure said lavatory shroud member to said lavatory section of said interface unit; and t. a modular cabinet adapted to be positioned adjacent said lavatory section of said interface unit above said modular wash bowl, and means to supportedly position said cabinet on an upper portion of said lavatory shroud, said modular, pre-dimensioned units being capable of being readily assembled to form at least a powder room due to the convenient template provided by said interface unit and drain-waste-vent pipe unit.

2. The assemblage of units according to claim 1 wherein each waste inlet opening of said drain-waste-vent pipe unit comprises a cross-connection defining opposed openings positioned on opposite sides of the pipe system such that both drain openings are selectively connectable to interface units associated with oppositely positioned rooms while each drain opening is adapted to be selectively inactivated by a plug member.

3. The assemblage of units according to claim 1 wherein said structural members of said interface frame are so dimensioned and configured as to be capable of being selectively assembled in at least one of two positions with said toilet bowl being connectable to either side of the lavatory section.

4. The assemblage of units according to claim 3 further comprising illumination means adapted to be secured to said modular cabinet, said illumination means adapted to be electrically connected to an electrical supply terminal of the building structure secured to said interface unit of said lavatory section.

5. The assemblage according to claim 4 further comprising a raised lip extending upwardly from at least three peripheral edge portions of said bathtub and means on said first, second and third shroud members to interlock said wall shroud members with said raised lip portions to thereby provide a substantially watertight seal between said finished shower enclosure formed by said shroud members and said bathtub.

6. An assemblage of a plurality of pre-dimensioned and pre-engineered modular units adapted to be assembled to form at least a full bathroom within a room section of a building structure which comprises:

a. an interface frame adapted to be mounted adjacent to a wet wall protion of a room section, the wet wall portion having a water pipe system extending therethrough associated with the building water supply means, said interface frame being formed of structural frame members dimensioned and configured to be connected in at least one of a plurality of relative positions which define locating positions at least for lavatory, toilet, and bathtub sections;

b. a horizontal support bracket associated with each section defined by said interface frame, each bracket being connectable to the structural members forming each interface frame section so as to adapt said frame sections to define interface support means for modular lavatory, toilet, and bathtub units;

c. a drain-waste-vent pipe unit adapted to be supported substantially vertically within the wet wall of the room section and adapted to be connected to a drain-waste-vent pipe system of the building structure;

d. drain waste-vent pipe members adapted to be connected in end-to-end relation and capable of being supported within the interface frame structure to form an interface unit adapted to provide a drain-waste-vent pipe system for the room section;

e. means adapted to connect the vent system of the building structure;

f. a modular pre-dimensioned toilet bowl adapted to be supported on the floor of the room section and further adapted to be positioned adjacent said horizontal support bracket associated with said toilet section of said interface frame, said toilet bowl defining flush water inlet and waste outlet means at the rear portion thereof;

g. means to secure the rear portion of said toilet bowl to said horizontal support bracket associated with the toilet section of said interface frame and means to connect the flush waste outlet of said toilet bowl to the waste outlet of said interface unit;

h. a substantially finished shroud member adapted and dimensioned to be selectively removably positioned about at least a portion of said toilet bowl adjacent the toilet section of said interface frame, said shroud member having means to accumulate flush water therein and control means to selectively release the flush water through an opening defined by a lower portion of said water accumulating means;

i. means to connect the water supply system of the wet wall to said flush water accumulating means to selectively accumulate flush water therein;

j. means to connect the lower opening defined by said flush water accumulating means to the flush water outlet portion of said toilet bowl;

k. means for supporting towels and the like adapted to be connected to said toilet section of said interface unit in a manner to secure said toilet shroud in adjacent relation with said interface unit comprising:

1. a first elongated member adapted to support towels and the like; and 2. at least first and second support members extending from each end portion of said towel support member and adapted to be extended through the toilet bowl shroud at a position above the toilet locating position, said first and second support members further comprising means to secure the towel support means and toilet shroud to said interface unit;

l. a modular cabinet member adapted to be supported on the floor of the room section and secured to said lavatory section of said interface frame;

m. a modular wash bowl adapted to be supported on said cabinet member adjacent said lavatory section of said interface unit, said wash bowl having a lower drain outlet means;

n. means to connect the water supply of said wet wall to said modular wash bowl;

o. means to selectively activate and direct water from said water supply to said wash bowl;

p. means to connect the drain outlet means of said wash bowl to the drain system of said interface unit;

q. a substantially finished shroud member adapted to be positioned in adjacent relation against said lavatory section of said interface unit above said cabinet;

r. a dish for soap and the like having fastener means adapted to be extended through said lavatory shroud in a manner to secure said shroud member to said lavatory section of said interface unit;

s. means adapted to support tooth brushes and the like comprises fastener means adapted to be extended through said lavatory shroud in a manner to further secure said shroud member to said lavatory section of said interface unit;

t. a modular cabinet member adapted to be positioned adjacent said lavatory section of said interface unit above said modular wash bowl and having means to supportedly position said cabinet on an upper portion of said lavatory shroud;

u. a modular pre-dimensioned bathtub adapted to be supported on the floor of said room section in adjoining relation to the bathtub section of said interface frame unit, said bathtub having a generally rectangular configuration and at least a rearward shorter side portion having a generally arcuate configuration so as to adapt it to be rotated into position into said room section adjacent said bathtub section of said interface unit, said bathtub further comprising means to securely attach the forward portion thereof to the horizontal bracket member of said bathtub section of said interface frame, and a ridge extending upwardly along at least one peripheral upper side edge portion;

v. control means to selectively activate and direct water into said bathtub;

w. means to connect a drain opening defined by the lower portion of said bathtub to the drain pipe sections associated with said interface unit;

x. means to connect the water supply pipes of the room section associated with the water supply of the building structure to the water control means of the bathtub;

y. pipe means adapted to be generally vertically connected to the bathtub water supply pipes, said pipe section being capable of directing water to a level above the first water control means;

z. a first bathtub shroud member adapted to be supported on a first side portion of said bathtub and adapted to surround a portion of the room section above said bathtub, said shroud member further defining a slotted portion along a lower peripheral edge portion to at least partially engagingly receive said upstanding ridge extending along a corresponding adjacent portion of said bathtub in a manner to form a substantially water-tight seal therebetween;

aa. a second bathtub shroud member adapted to be supported on a second side portion of said bathtub and capable of being interlockingly connectable to said first bathtub surround member and in adjacent relation to a wall portion of the room section, said shroud member further defining a slotted portion along a lower peripheral edge portion to at least partially engagingly receive said upstanding ridge extending along a corresponding adjacent portion of said bathtub to form a substantially water-tight seal therebetween;

bb. a third bathtub shroud member adapted to be supported on a third side portion of said bathtub in interlocking relation with said second bathtub surrounded in adjacent relation to adjoining wall portions of said room section, said shroud member further defining a slotted portion along a lower peripheral edge portion to at least partially engagingly receive said upstanding ridge extending along a corresponding adjacent portion of said bathtub to form a substantially water-tight seal therebetween;

cc. shower pipe means adapted to be extended through an opening defined by said first bathtub surround and having means to be secured to the shower water supply pipe members and to secure said first bathtub shroud member to an adjoining wall portion of said room section;

dd. a water supply spout having a fastener means adapted to be extended into said first bathtub shroud member and capable of being fastened to water supply pipes of said room section and having means connected thereto to secure said first bathtub shroud member to an adjoining wall portion of said room section;

ee. a bathtub drain control means having first open and second closed positions, said control means being adapted to be extended through said first wall shroud member in a manner connecting said control means to the drain portion defined by said bathtub, said drain control means further having means to secure said first bathtub shroud member to an adjoining wall portion of said room section; and ff. an elongated rod member for supporting shower curtains and the like and adapted to be extended from a first portion of said first bathtub shroud member to a portion of said third bathtub shroud member in a manner to forcibly secure opposed portions of said bathtub shroud members against respective adjacent wall portions of the room section to secure said bathtub shroud members in position, said rod member thereby being capable of being supported in position above a portion of said bathtub to support shower curtains and the like, said interface unit and associated pre-engineered and pre-dimensioned modular units being capable of establishing a modular bathroom in a convenient manner.

7. In an assemblage of a plurality of units adapted to be assembled to form at least a powder room within a room section of a building structure having structural means adapted to be mounted adjacent to a wet wall portion of the room section, the wet wall portion having a water pipe system extending therethrough, the structure supporting pipe members defining the drain-waste-vent system of the room and communicating said drain-waste-vent system with the drain-waste-vent system of the building structure, said structure defining means adapted to support at least a plurality of powder room fixtures thereagainst, means to secure said powder room fixtures so as to be supported in adjacent relation to the structural member, the improvement in combination therewith which comprises a modular pre-engineered interface frame structure adapted to be assembled and mounted in adjoining relation adjacent to a wet wall portion of the room section, the wet wall portion having a water supply pipe system extending therethrough associated with the building water supply, said interface frame being formed of structural frame members dimensioned and configured to be selectively connected in at least one of a plurality of relative positions which define locating positions at least for toilet and lavatory sections, a horizontal support bracket associated with each section defined by said interface frame being connectable to the structural members forming each interface frame section so as to adapt said frame sections to define interface support means at least for modular toilet and lavatory sections, a drain-waste-vent pipe unit adapted to be supported substantially vertically within at least a portion of the wet wall of the room section and adapted to be connected to a drain-waste-vent pipe system of the building structure, drain-waste-vent pipe members adapted to be connected in end-to-end relation and capable of being supported within the interface frame structure to form an interface unit adapted to provide a drain-waste-vent pipe system for the room section, means adapted to connect the vent system of the interface unit to the vent system of the building structure, a modular pre-dimensioned toilet bowl adapted to be supported on the floor of the room section and adapted to be positioned adjacent said horizontal support bracket associated with said toilet section of said interface unit, said toilet bowl defining flush water inlet and waste outlet means at the rear portion thereof, a substantially finished shroud member adapted and dimensioned to be selectively removably positioned about at least a portion of said toilet bowl adjacent the toilet section of said interface unit, said shroud member having means to accumulate flush water therein and control means to selectively release the flush water through an opening defined by a lower portion of said water accumulating means, means to connect the water supply system of the wet wall to said flush water accumulating means to selectively accumulate flush water therein, means to connect the lower opening defined by said flush water accumulating means to the flush water inlet portion of said toilet bowl, a modular wash bowl adapted to be supported on said cabinet member adjacent said lavatory section of said interface unit, said wash bowl defining a lower drain outlet means, means to connect the water supply of said wet wall to said modular wash bowl, means to selectively activate and direct water from said water supply to said wash bowl, means to connect the drain outlet means of said bowl to the drain system of said interface unit, a substantially finished shroud member adapted to be positioned in adjacent relation against said lavatory section of said interface unit above said cabinet, fastener means capable of securing at least a portion of said modular pre-dimensioned units adjacent said modular interface frame section, while simultaneously being capable of decoratively completing said powder room and supporting items such as towels, soap, tooth brushes and the like, and the modular, pre-dimensioned, relative structural configurations of said units rendering said units capable of assembly to quickly form at least a powder room within the room section.

8. In an assemblage of a plurality of units adapted to be assembled to form at least a full bathroom within a room section of a building structure having structural means adapted to be mounted adjacent to a wet wall portion of the room section, the wet wall portion having a water pipe system extending therethrough, the structure supporting pipe members defining the drain-waste-vent system of the room and communicating said drain-waste-vent system with the drain-waste-vent system of the building structure, said structure defining means adapted to support at least a plurality of bathroom fixtures thereagainst, means to secure said bathroom fixtures so as to be supported in adjacent relation to the structural member, the improvement in combination therewith which comprises an interface frame structure adapted to be mounted in adjoining relation and adjacent to a wet wall portion of the room section, the wet wall portion having a water supply pipe system extending therethrough associated with the building water supply, said interface frame being formed of structural frame members dimensioned and configured to be selectively connected in at least one of a plurality of relative positions which define locating positions at least for toilet, lavatory and bathtub sections, a horizontal support bracket associated with each section defined by said interface frame being connectable to the structural members forming each interface frame section so as to adapt said frame sections to define interface support means at least for modular toilet, lavatory and bathtub sections, a drain-waste-vent pipe unit adapted to be supported substantially vertically within at least a portion of the wet wall of the room section and adapted to be connected to a drain-waste-vent pipe system of the building structure, drain-waste-vent pipe members adapted to be connected in end-to-end relation and capable of being supported within the interface frame structure to form an interface unit adapted to provide a drain-waste-vent pipe system for the room section, means adapted to connect the vent system of the interface unit to the vent system of the building structure, a modular pre-dimensioned toilet bowl adapted to be supported on the floor of the room section and adapted to be positioned adjacent said horizontal support bracket associated with said toilet section of said interface unit, said toilet bowl defining flush water inlet and waste outlet means at the rear portion thereof, a substantially finished shroud member adapted and dimensioned to be selectively removably positioned about at least a portion of said toilet bowl adjacent the toilet section of said interface unit, said shroud member having means to accumulate flush water therein and control means to selectively release the flush water through an opening defined by a lower portion of said water accumulating means, means to connect the water supply system of the wet wall to said flush water accumulating means to selectively accumulate flush water therein, means to connect the lower opening defined by said flush water accumulating means to the flush water inlet portion of said toilet bowl, a modular wash bowl adapted to be supported on said cabinet member adjacent said lavatory section of said interface unit, said wash bowl having a lower drain outlet means, means to connect the water supply of said wet wall to said modular wash bowl, means to selectively activate and direct water from said water supply to said wash bowl, means to connect the drain outlet means of said wash bowl to the drain system of said interface unit, a substantially finished shroud member adapted to be positioned in adjacent relation against said lavatory section of said interface unit above said cabinet, a modular pre-dimensioned bathtub adapted to be supported on the floor of said room section in adjoining relation to the bathtub section of said interface frame unit, said bathtub having a generally rectangular configuration and at least one shorter side portion having a generally arcuate configuration so as to adapt it to be rotated into position into said room section adjacent said bathtub section of said interface unit, said bathtub further comprising means to securely attach the forward portion thereof to the horizontal bracket member of said bathtub section of said interface frame, and a ridge extending upwardly along at least one peripheral upper side edge portion, control means to selectively activate and direct water into said bathtub, means to connect a drain opening defined by the lower portion of said bathtub to the drain pipe sections associated with said interface unit, means to connect the water supply pipes of the room section associated with the water supply of the building structure to the water control means of the bathtub, a pipe means adapted to be generally vertically connected to the bathtub water supply pipes, said pipe section being capable of directing water into said bathtub from a level above the first water control means, a first bathtub shroud member adapted to be supported on a first side portion of said bathtub and adapted to surround a portion of the room section above said bathtub, said shroud member further defining a slotted portion along a lower peripheral edge portion to at least partially engagingly receive said upstanding ridge extending along a corresponding portion of said bathtub to form a substantially water-tight seal therebetween, a second bathtub shroud member adapted to be supported on a second side portion of said bathtub and capable of being interlockingly connectable to said first bathtub shroud member in adjacent relation to a wall portion of the room section, said shroud member further defining a slotted portion along a lower peripheral edge portion to at least partially engagingly receive said upstanding ridge extending along a corresponding portion of said bathtub to form a substantially water-tight seal therebetween, a third bathtub shroud member adapted to be supported on a third side portion of said bathtub in interlocking relation with said second bathtub surrounded in adjacent relation to adjoining wall portions of said room section, said shroud member further defining a slotted portion along a lower peripheral edge portion to at least partially engagingly receive said upstanding ridge extending along a corresponding portion of said bathtub to form a substantially water-tight seal therebetween, a shower pipe means adapted to be extended through an opening defined by said first bathtub surround and having means to be secured to the shower water supply pipe members and to secure said first bathtub shroud member to an adjoining wall portion of said room section, a water supply spout having fastener means adapted to be extended into said first wall surround member and capable of being fastened to water supply pipes of said room section and having means to secure said first bathtub shroud member to an adjoining wall portion of said room section, a bathtub drain control means having first open and second closed positions, said control means being adapted to be extended through said first wall surround member in a manner connecting said control means to the drain portion defined by said bathtub, said drain bathtub surround member to an adjoining wall portion of said room section, an elongated rod member for supporting shower curtains and the like and adapted to be extended from a first portion of said first bathtub surround member to a portion of said third bathtub shroud member in a manner to forcibly secure opposed portions of said bathtub surround members against respective adjacent wall portions of the room section while being supported in position above a portion of said bathtub, said fastener means capable of securing said modular pre-dimensioned units adjacent said modular interface frame section, while simultaneously being capable of decoratively completing said bathroom and supporting items such as towels, soap, tooth brushes and the like, and the modular, pre-dimensioned, relative structural configurations of said units rendering said units capable of assembly to quickly form at least a bathroom within the room section.

* * * * *

UNITED STATES PATENT AND TRADEMARK OFFICE

CERTIFICATE OF CORRECTION

PATENT NO. : 3,978,529

DATED : September 7, 1976

INVENTOR(S) : Kurt Krafft

It is certified that error appears in the above-identified patent and that said Letters Patent are hereby corrected as shown below:

Column 2, line 32, "of a structural" should be -- of structural --

Column 2, line 36, "room. a" should be -- room. A --

Column 3, line 15, after "back-to-back relation, etc." insert the following:

-- This advantage is particularly due to the symmetrical and interchangeable features of the members forming the interface core which make it possible to assemble the core according to a plurality of arrangements --

Column 5, line 32, "a perspective" should be -- an exploded perspective --

Column 6, line 12, "aand" should be -- and --

Column 6, line 18, "water closet, toilet" should be -- water closet, washroom, toilet --

Column 7, line 20, after "vanity sink section" insert the following:

-- each being telescopingly connected to the vertical and horizontal support members as shown in Figs. 2, 3 and 4 --

UNITED STATES PATENT AND TRADEMARK OFFICE

CERTIFICATE OF CORRECTION

PATENT NO. : 3,978,529

DATED : September 7, 1976

INVENTOR(S) : Kurt Krafft

It is certified that error appears in the above-identified patent and that said Letters Patent are hereby corrected as shown below:

Column 12, line 1, "provided" should be -- provide --

Column 15, line 22, "outlet portion" should be -- inlet portion --

Signed and Sealed this

*thirtieth* Day of *August 1977*

[SEAL]

*Attest:*

RUTH C. MASON
*Attesting Officer*

C. MARSHALL DANN
*Commissioner of Patents and Trademarks*